United States Patent [19]

Hannemann

[11] 4,417,535

[45] Nov. 29, 1983

[54] SEWING MACHINE BELT FEEDER WITH TENSIONER

[75] Inventor: Franz Hannemann, Detmold, Fed. Rep. of Germany

[73] Assignee: Dürkoppwerke GmbH, Bielefeld, Fed. Rep. of Germany

[21] Appl. No.: 331,919

[22] Filed: Dec. 17, 1981

[30] Foreign Application Priority Data

Dec. 19, 1980 [DE] Fed. Rep. of Germany ..... 3048012

[51] Int. Cl.[3] ..... D05B 27/04

[52] U.S. Cl. ..... 112/304; 198/814

[58] Field of Search ..... 112/304, 313; 271/275, 271/198; 198/814, 815

[56] References Cited

U.S. PATENT DOCUMENTS 4,311,106 1/1982 Hanneman ..... 112/313

FOREIGN PATENT DOCUMENTS 140693 4/1951 Australia ..... 198/813

2426538 8/1977 Fed. Rep. of Germany .

*Primary Examiner*—Werner H. Schroeder

*Assistant Examiner*—Andrew M. Falik

*Attorney, Agent, or Firm*—Karl F. Ross

[57] ABSTRACT

A workpiece transporter for a sewing machine comprises an endless conveyor belt looped around a driving sheave and several deflecting rollers, the latter including a first and a second roller carried on the free ends of respective spring-loaded levers placing that belt only under a moderate tension. The first deflecting roller is closely juxtaposed with the upstream side of the driving sheave, its axis defining with that of the sheave and with the fulcrum of its lever an obtuse triangle whose vertex angle increases as that roller approaches the sheave when an obstacle retards the belt motion, such approach clamping the belt more tightly between the roller and the sheave for firmer entrainment.

4 Claims, 4 Drawing Figures

SEWING MACHINE BELT FEEDER WITH TENSIONER

CROSS-REFERENCE TO RELATED APPLICATION

This application contains subject matter disclosed in my copending application Ser. No. 089,860 filed Oct. 31, 1979, now U.S. Pat. No. 4,311,106.

FIELD OF THE INVENTION

My present invention relates to a transporter designed to move a workpiece layer past a reciprocating needle of a sewing machine, particularly (but not exclusively) the upper one of two stacked fabric layers to be stitched together with an adjustable speed difference as described in my above-identified prior application and patent.

BACKGROUND OF THE INVENTION

The transporter here envisaged comprises an endless belt which is entrained by a rotating sheave partly enveloped thereby and also passes about several deflecting rollers some of which define a stretch of that belt adjoining the path of the workpiece to be advanced by the belt in a predetemined transport direction. Such a transporter is also known, for example, from German patent No. 24 26 538.

If a crease in the workpiece or a thickening thereof, a transverse seam or some other obstacle impedes the belt motion, the driving sheave will tend to slip. Such a slippage is undesirable in any sewing machine but is particularly objectionable in the stitching of two stacked layers since, with the transporter for the other layer continuing at its normal speed, the relative position of the two layers may be unacceptably changed. It has therefore already been proposed to replace the frictionally entrained transport belts by perforated bands coacting with associated sprocket wheels; this, however, increases the space required for the driving mechanism and may even interfere with a viewing of the stitching operation since the sprockets necessarily have a larger diameter than a plain sheave. Another possible solution resides in making the belt very tight in order to intensify its contact with the sheave, yet this results in an accelerated wear and requires the use of heavier belts.

OBJECT OF THE INVENTION

The object of my present invention, therefore, is to provide an improved transporter of the type referred to which uses a frictionally entrained belt of limited thickness and under moderate tension but which nevertheless maintains a substantially constant feed rate despite possible obstacles tending to retard the advance of the workpiece.

SUMMARY OF THE INVENTION

In accordance with my present invention, the deflecting rollers engaged by the endless belt include a first roller closely approaching an upstream side of the driving sheave, a second roller downstream of that sheave and a third roller upstream of the first roller. The first roller is carried on a free end of a first lever with a fixed fulcrum defining with the axes of that roller and of the sheave, in the plane of belt motion, a triangle having an obtuse angle at the roller axis; the third roller lies between the sides of the triangle including that obtuse angle in order to exert upon the first roller a force tending to move same closer to the sheave in response to a slowing of the belt which is thereby clamped between that roller and the sheave. The second roller is carried on a free end of a second lever which also has a fixed fulcrum and is engaged by spring means placing the belt under a tension which is insufficient to clamp same between the first roller and the sheave in the absence of a belt-slowing obstacle.

BRIEF DESCRIPTION OF THE DRAWING

The above and other features of my invention will now be described in greater detail with reference to the accompanying drawing in which.

SPECIFIC DESCRIPTION

Figure 1:
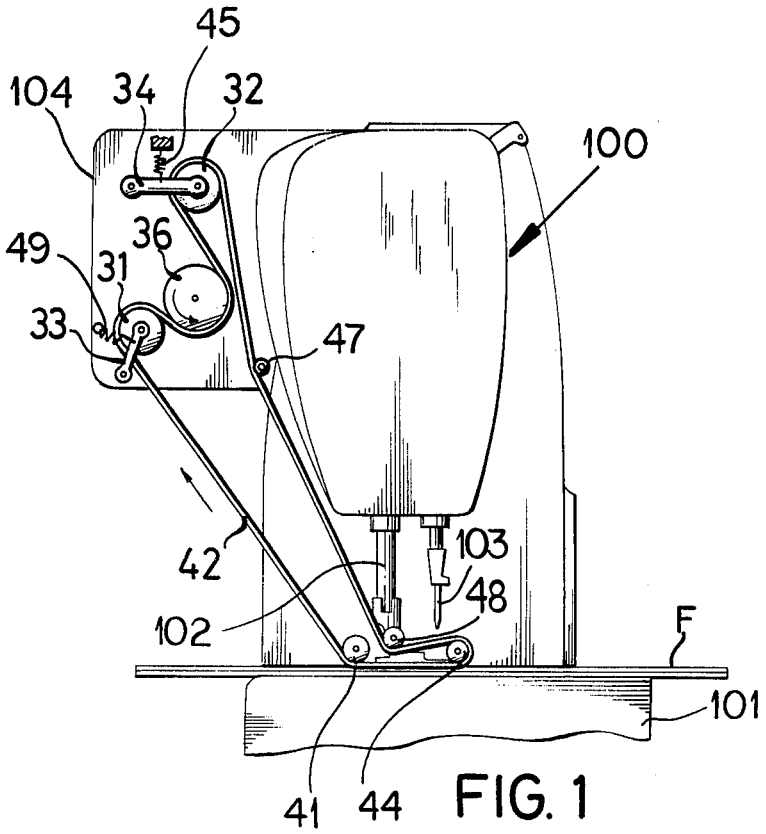
FIG. 1 is an end-elevational view of a sewing machine provided with an upper transporter embodying the present improvement.

In FIG. 1 I have shown a sewing machine 100 which is generally similar to that described in my above-identified copending application and patent whose disclosure is hereby incorporated by reference in the present specification. The machine is supported by a table 101 in which a lower transporter, not shown, entrains a fabric layer F resting on that table as part of a two-layer stack held down by a presser foot 102 for stitching by a vertically reciprocating needle 103. The upper layer of the stack is entrained, at a rate bearing a predetermined relationship to the forward motion of the lower layer, by an associated transporter comprising an endless belt 42 which is looped around a sheave 36 and a plurality of deflecting rollers 31, 32, 41, 44, 47 and 48. Rollers 41 and 44 are disposed close to table 101 and define between them a horizontal belt stretch in contact with the upper fabric layer F. Two levers 33 and 34 are pivotable about fixed fulcra 38 and 46 (FIG. 2) on a housing attachment 104 elevated above table 101; this attachment also contains the drive mechanism for the shaft of sheave 36. Roller 31, carried on a free end of lever 33, is normally separated from the upstream side of sheave 36 by a narrow gap slightly greater than the belt width whereas roller 32, mounted on a free end of lever 34, is more widely spaced from the downstream side of the sheave; these two rollers and the sheave are therefore remote from deflecting rollers 41 and 42 disposed at the ends of the horizontal belt stretch. A spring 45 engages the lever 34 to impart a moderate tension to belt 42.

FIG. 1 also shows another spring 49 engaging the lever 33 in a manner tending to increase the gap between roller 31 and sheave 36. That spring could also be replaced by other biasing means such as, for example, a weighted extension of lever 33. To maintain a predetermined maximum gap width during normal operation, this lever may be held by its biasing means against a fixed stop not shown; the normal belt tension is then determined exclusively by spring 45.

Figure 2:
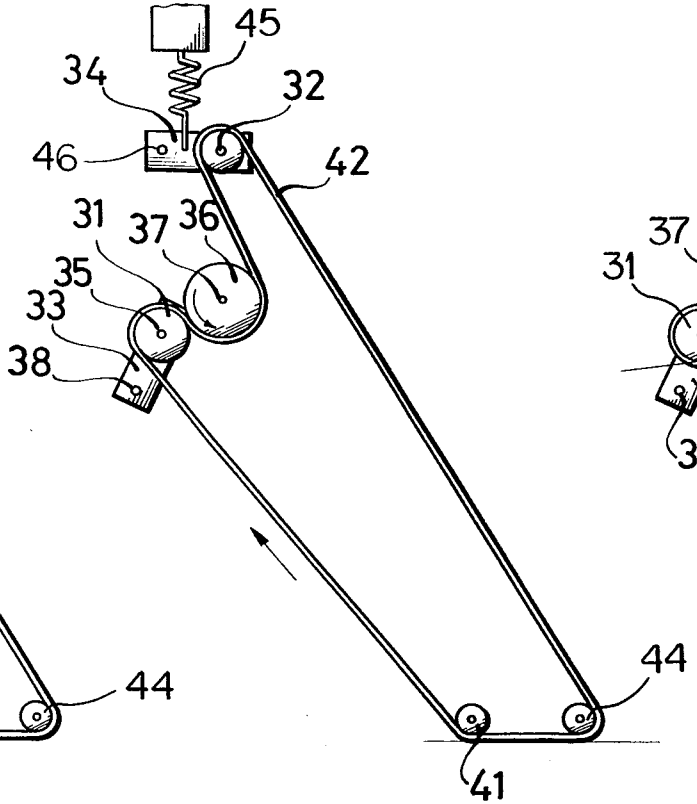
FIG. 2 is an elevational view of a transporter differing but slightly from that shown in FIG. 1.

FIG. 2 shows a somewhat simplified array of deflecting or guide rollers, with omission of rollers 47 and 48 and with a modified representation of levers 33 and 34. In the plane of motion of belt 42, fulcrum 38 of lever 33 defines with axes 35 and 37 of roller 31 and sheave 36 a triangle having an obtuse angle at axis 35. If an obstacle impedes the advance of the fabric layer entrained by belt 42, the ascending run of that belt between rollers 41 and 35 will come under increased tension whereby lever 33 is deflected in a clockwise sense and in opposition to its biasing force to narrow the gap separating it from sheave 36. This results in a firmer clamping of the belt within that gap as the obtuse angle of the aforementioned triangle 35, 37, 38 is widened. The pressure thereby exerted upon the belt prevents a significant slip relative to sheave 36 so that the feed rate of the engaged workpiece is maintained substantially unaltered.

Figure 3:
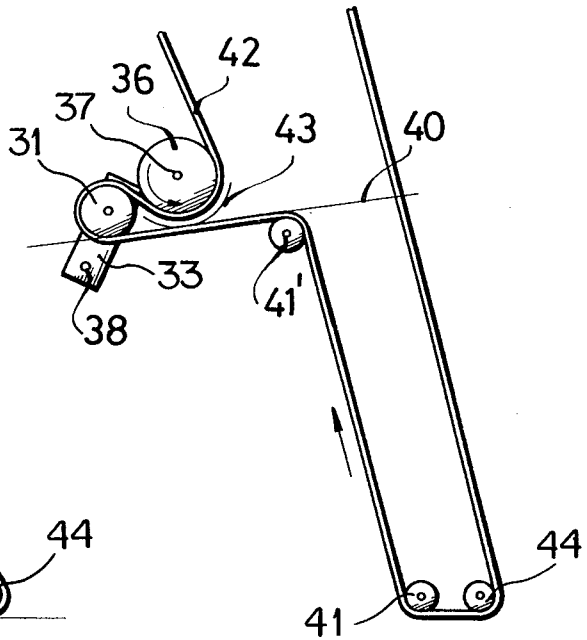
FIGS. 3 and 4 are fragmentary views of two modifications of the transporter shown in FIG. 2.
Figure 4:
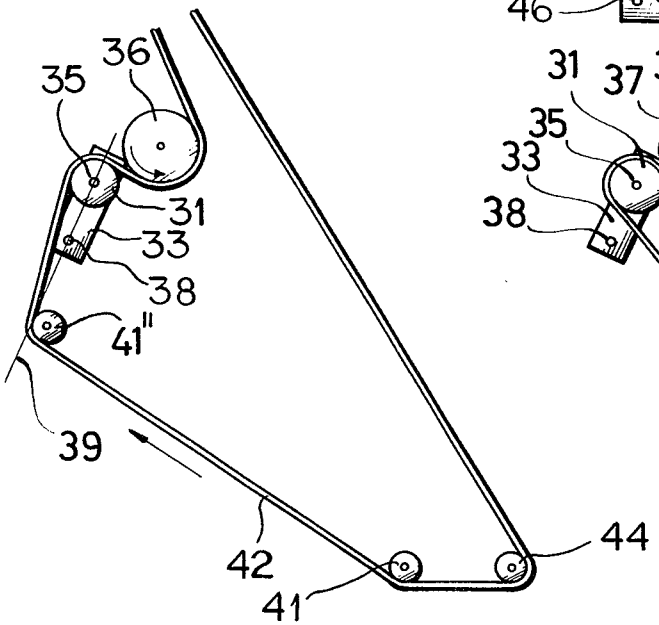

The position of the deflecting roller immediately preceding roller 35 in the transport direction, i.e. the roller 41 in FIGS. 1 and 2, must be chosen as to bring about the desired clockwise swing of lever 33 in response to a retardation of the workpiece motion. In general, therefore, roller 41 will have to lie between the two triangle sides defined by axis 35 with axis 37 and with fulcrum 38, respectively. FIG. 3 shows one limiting position of such an upstream roller 41' given by the requirement that the part of the belt passing from roller 41' to roller 31 must not touch the part wound about sheave 36; this means that the periphery of roller 41' should be separated by at least one belt thickness from a line 40 which is tangent to roller 31 (in its normal position) and to an arc 43 centered on axis 37 with a radius exceeding that of sheave 36 by the thickness of the belt plus a certain safety margin. Another limiting position has been illustrated in FIG. 4 for an upstream roller 41'' which is tangent to a line 39 passing through axis 35 and fulcrum 38, again in the normal position of lever 33 and roller 31. From FIGS. 3 and 4 it will also be apparent that a deflecting roller lying to the left of a line tangent to rollers 31 and 41 will engage the inner belt surface whereas a deflecting roller to the right of that line will engage the outer belt surface.

Although my improved belt-guiding arrangement has been described only for an upper transporter, it will be apparent that a similar arrangement could be used for the nonillustrated lower transporter; even when the workpiece to be entrained consists of a single fabric layer, a transporter according to my invention may be useful.

I claim:

1. A transporter for moving a workpiece layer past a reciprocating needle of a sewing machine, comprising:

an endless belt having a stretch adjoining the path of a workpiece layer to be advanced thereby in a predetermined transport direction;

a rotating sheave partly enveloped by said belt at a location remote from said stretch for entraining same in a sense consistent with said transport direction;

a plurality of deflecting rollers engaged by said belt for guiding same around said sheave and along said stretch, said deflecting rollers including a first roller closely approaching an upstream side of said sheave, a second roller downstream of said sheave and a third roller upstream of said first roller;

a first lever having a fixed first fulcrum and a free end carrying said first roller, said first fulcrum defining with the axes of said first roller and of said sheave a triangle lying in the plane of belt motion and having an obtuse angle at the axis of said first roller, said third roller lying between the sides of said triangle including said obtuse angle for exerting upon said first roller a force tending to move the latter closer to said sheave in response to a slowing of said belt by an obstacle along said stretch with resulting clamping of said belt between said first roller and said sheave;

a second lever having a fixed second fulcrum and a free end carrying said second roller; and spring means engaging said second lever for placing said belt under a tension insufficient to clamp same between said first roller and said sheave in the absence of a belt-slowing obstacle along said stretch.

2. A transporter as defined in claim 1 wherein said third roller lies at a downstream end of said stretch.

3. A transporter as defined in claim 1 wherein said third roller lies between said first roller and a fourth roller disposed at a downstream end of said stretch.

4. A transporter as defined in claim 1, 2 or 3, further comprising biasing means engaging said first lever for holding said first roller spaced from said sheave.

* * * * *